United States Patent [19]

Cherian

[11] Patent Number: 4,591,145

[45] Date of Patent: May 27, 1986

[54] SHEET TRANSPORT

[75] Inventor: Abraham Cherian, Webster, N.Y.

[73] Assignee: Xerox Corporation, Stamford, Conn.

[21] Appl. No.: 725,971

[22] Filed: Apr. 22, 1985

[51] Int. Cl.[4] ..... B65H 7/06

[52] U.S. Cl. ..... 271/258; 271/265; 310/330; 310/368

[58] Field of Search ..... 271/227, 258, 259, 261, 271/263, 265; 226/23, 45; 310/330, 331, 332, 368

[56] References Cited

U.S. PATENT DOCUMENTS

| | | | |
|---|---|---|---|
| 2,793,035 | 5/1957 | Wroblewski | 271/259 |
| 3,126,536 | 3/1964 | Schnell | 271/259 X |
| 3,155,244 | 11/1964 | Rogers | 271/258 X |
| 3,283,164 | 11/1966 | Remeika | 310/331 X |
| 3,519,800 | 7/1970 | Shill | 310/330 X |
| 4,025,186 | 5/1977 | Hunt, Jr. et al. | 355/14 |
| 4,066,969 | 1/1978 | Pearce et al. | 328/5 |
| 4,110,654 | 8/1978 | Paul | 310/332 X |
| 4,387,318 | 6/1983 | Kolm | 310/331 X |
| 4,397,459 | 8/1983 | Silverberg et al. | 271/94 |

*Primary Examiner*—Richard A. Schacher

*Attorney, Agent, or Firm*—H. Fleischer; J. E. Beck; R. Zibelli

[57] ABSTRACT

A sheet transport in which sheets move along a selected path. A piezoelectric strip is positioned to have the generally planar surface thereof extending in a direction substantially normal to the path of movement of the sheet. As the sheet deflects the piezoelectric strip, an electrical signal is generated indicating the presence of the sheet at that point in the sheet path.

10 Claims, 2 Drawing Figures

SHEET TRANSPORT

Figure 1:
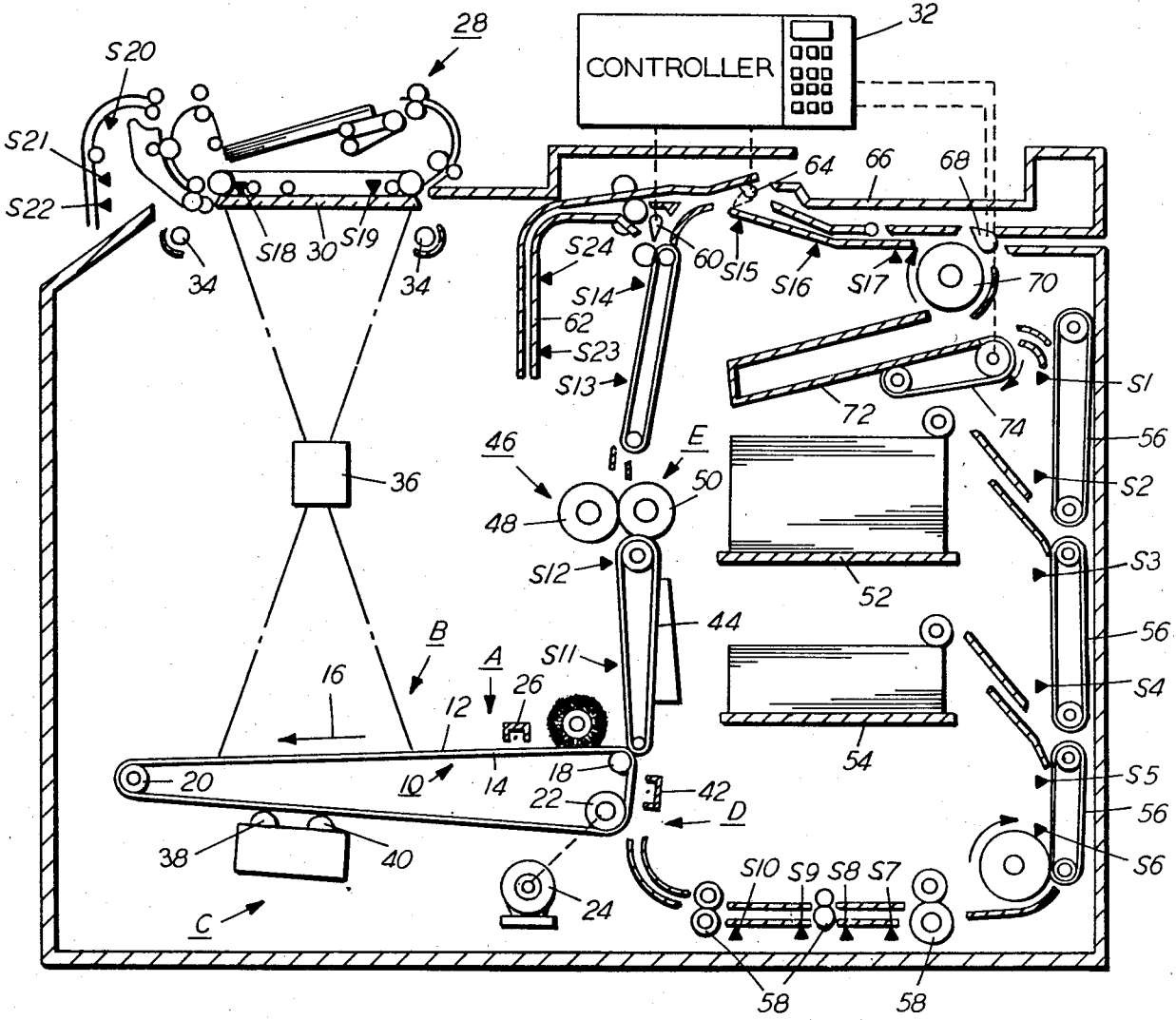

This invention relates generally to a sheet transport used in an electrophotographic printing machine, and more particularly concerns an improved sensor for detecting sheet jams therein.

Electrophotographic printing machines employ document handling systems and sheet transports. Document handlings systems recirculate the original document so as to rapidly reproduce a plurality of copies. These copies may be formed into sets corresponding to the set of original documents. The printing machine also includes high speed sheet transports for advancing the copy sheet through the various processing stations. Occasionally, documents or sheets jam. The location of the jammed sheet or document must be detected and displayed to the operator so that the jammed sheets or documents may be readily removed from the printing machine. Hereinbefore, various sensors were employed to detect the location of the jammed sheet. In addition, these sensors indicate the location of the sheet to enable the processing stations within the printing machine to be controlled by the printing machine controller as a function of the sheet or document location. Exemplary sensors previously employed are optical sensors and microswitches. However, these sensors are frequently sensitive to dirt and static electricity. Furthermore, the signal produced from these sensors was not always reliable. In todays highly competitive marketplace, it is necessary to reduce the cost of all of the subcomponents within an electrophotographic printing machine. This includes the sensors. Optical sensors and microswitches are fairly complex and relatively costly items. Accordingly, it is highly desirable to simplify sheet or document sensors, as well as improving their reliability and insensitivity to dirt and static electricity. Various types of sensors have been devised for detecting sheets or documents. The following disclosures appear to be relevant:

U.S. Pat. No.: 4,025,186 Patentee: Hunt, Jr. et al. Issued: May 24, 1977.

U.S. Pat. No.: 4,066,969 Patentee: Pearce et al. Issued: Jan 3, 1978.

U.S. Pat. No.: 4,397,459 Patentee: Silverberg et al. Issued: Aug. 9, 1983.

The pertinent portions of the foregoing disclosures may be briefly summarized as follows:

Hunt, Jr. et al. discloses bimorph sensors to detect the perforations in a photoconductive belt. The biomorph sensors include a piezoelectric crystal attached to a single step sensor element, the crystal ends of which bear on and slide against the moving web.

Pearce et al. describes a multiple sheet detector employing piezoelectric transducers. The transducers utilize a piezoelectric ceramic binder bonded to an aluminum plate. A pair of spaced apart transducers are employed with the sheet passing therebetween.

Silverberg et al. discloses a document handling unit in which the stack of documents is air supported. A piezoelectric pickup detects when the side edge of the document stack is in contact therewith to provide a measurement of the presence or absence of an air gap between the bottommost sheet of the stack and the support tray.

In accordance with one aspect of the features of the present invention, there is provided a sheet transport including means for moving a sheet along a selected path. Means, positioned to have a generally planar surface thereof extending in a direction substantially transverse to the selected path of sheet movement, generate an electrical signal in response to being deflected by the sheet moving along the selected path.

Pursuant to another aspect of the features of the present invention, there is provided an electrophotographic printing machine of the type in which a sheet moves along a selected path. Means are provided for moving the sheet along the selected path. Means, positioned to have a generally planar surface thereof extending in the direction substantially transverse to the selected path of sheet movement, generate an electrical signal in response to being deflected by the sheet moving along the selected path.

Figure 2:
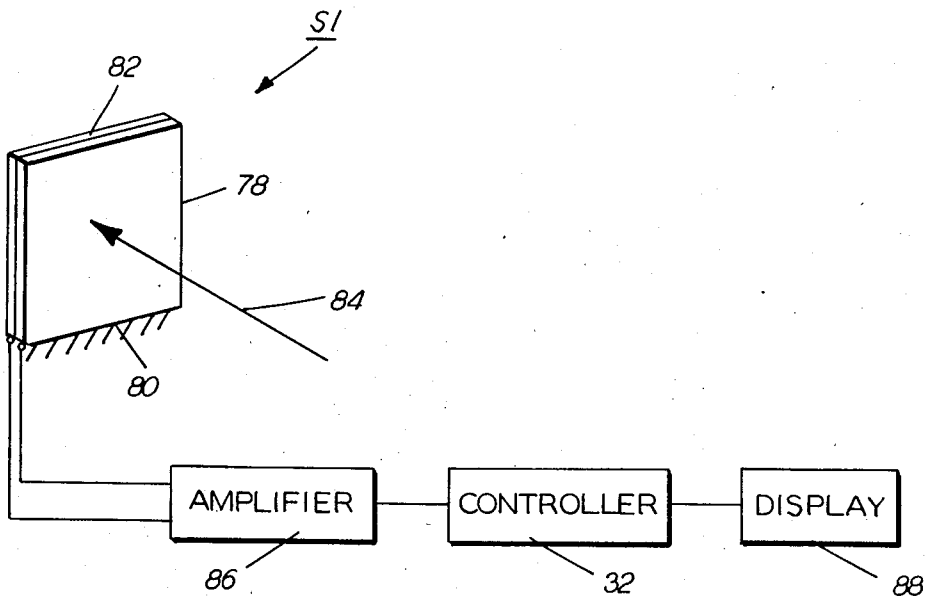

Other aspects of the invention will become apparent as the following description proceeds and upon reference to the drawings, in which:

FIG. 1 is an elevational view depicting an exemplary electrophotographic printing machine incorporating the features of the present invention therein; and FIG. 2 is an elevational view, partially in perspective, depicting the document sensor used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the sheet and document sensors of the present invention therein. It will become evident from the following discussions that the sensors of the present invention are equally well suited for use in a wide variety of sheet or document transports, and are not necessarily limited in their application to the particular printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive material and conductive substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Stripping roller 18 is mounted rotatably so as to rotate with the movement belt 10. Tensioning roller 20 is resiliently urged against belt 10 to maintain belt 10 under the desired tension. Drive roller 22 is rotated by motor 24 coupled thereto by suitable means, such as a drive belt. As roller 22 rotates, belt 10 advances in the direction of arrow 16.

Initially, a portion of photoconductive surface 12 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack of documents placed by the operator face down in a normal forward collating order in a document stacking and holding tray. A document feeder, located below the tray, forwards the bottom document of the stack to a pair of take away rollers. The bottommost sheet is then sent, by rollers, through a document guide to a feed roll and conveyor belt. The conveyor belt advances the document onto platen 30. After imaging, the original document is fed from platen 30 by the conveyor belt into a guide and feed roll pairs which advance the document into an inverter mechanism, or back to the document stack through the feed roll pairs. A decision gate is provided to divert the document either to the inverter or to the feed roll pairs. Document sensors S18 through S22 are shown for sensing the document location during imaging operation. However, any number of sensors may be used to give the required degree of document control desired. Each of the sensors S18–S22 are connected to controller 32. In this way, sensors S18–S22 sense the presence of the document and transmit a signal indicative thereof to controller 32. Imaging of a document on platen 30 is achieved by lamps 34 which illuminate the document positioned thereon. Light rays reflected from the document are transmitted through lens 36. Lens 36 focuses the light image of the original document onto the charged portion of photoconductive surface 12 to selectively dissipate the charge thereon. This records an electrostatic latent image on photoconductive surface 12 which corresponds to the informational areas contained within the original document. Thereafter, belt 10 advances the electrostatic latent image recorded on photoconductive surface 12 to development station C.

At development station C, a pair of magnetic brush developer rollers, indicated generally by the reference numerals 38 and 40, advance developer material into contact with the electrostatic latent image. The latent image attracts toner particles from the carrier granules of the developer material to form a toner powder image on photoconductive surface 12 of belt 10.

Belt 10 then advances the toner powder image to transfer station D. At transfer station D, a copy sheet is moved into contact with the toner powder image. Transfer station D, includes a corona generating device 42 which sprays ions onto the backside of the copy sheet. This attracts the toner powder image from photoconductive surface 12 of belt 10 to the sheet. After transfer, conveyor 44 advances the copy sheet to a fusing station E.

Fusing station E includes a fuser system indicated generally by the reference numeral 46. Preferably, the fusing system includes a heated fuser roller 48 and a back-up roller 50 with the toner powder image on the sheet contacting fuser roller 48. In this manner, the powder image is permanently affixed to the copy sheet.

Turning now to the path through which the copy sheets advance, the copy sheets are selected from one of the trays 52 or 54 and are advanced to transfer station D by conveyor belt 56 and feed rolls 58. After fusing, the copy sheets are fed to decision gate 60 which functions as an inverter selector. Depending upon the position of gate 60, the sheets will be deflected into sheet inverter 62 or bypass inverter 62 and be fed directly to a second decision gate 64. The sheets which bypass inverter 62 turn a 90° corner in the sheet path before reaching gate 64. This inverts the sheets into a face up orientation so that the image side, which has been transferred and fused is face up. If the inverter path 62 is selected, the opposite is true, i.e. the last printed side is face down. The second decision gate 64 either deflects the sheet directly into an output tray 66 or deflects the sheets into a transport path which carries them on without inversion to a third decision gate 68. Gate 68 either passes the sheets directly on without inversion into the output path of the copier or deflects the sheets onto a duplex inverter roller 70. Roller 70 inverts and stacks the sheets to be duplexed in duplex tray 72 when gate 68 so directs. Duplex tray 72 provides intermediate buffer storage for those sheets which have been printed on one side in which an image will be subsequently printed on the side opposed thereto, i.e. the sheets being duplexed. Due to the sheets being inverted by roller 68 the sheets are stacked in duplex tray 72 on top of one another in the order in which they are copied in the face down orientation. To complete duplex copying, the simplex sheets in duplex tray 72 are fed, in series, by bottom feeder 74 from tray 72 back to transfer station D for transfer of the toner powder image to the opposed side of the copy sheet. Conveyors 56 and rollers 58 advance the sheet along the path which produces an inversion thereof. However, inasmuch as the bottommost sheet is fed from duplex sheet 72, the proper or clean side of the copy sheet is in contact with belt 10 at transfer station D so that the toner powder image on photoconductive surface 12 is transferred thereto. The duplex sheets are then fed through the same path as the simplex sheets to be stacked in tray 66 for subsequence removal by the machine operator. Sensors S1–S17, S23 and S24 are shown for sensing copy sheet locations during a copy operation. However, any number of sensors could be used. Sensors S1–S17, S23 and S24 are electrically connected to controller 32. If one of the sensors indicates that that the sheet has not passed thereby at the appropriate time during the copying cycle, controller 32 actuates a display indicating that a sheet jam has occurred. All of the machine operations are then stopped permitting the operator to open the machine doors and remove the jammed copy sheet therefrom. Controller 32 is a programmable machine controller used to control the various operations of the electrophotographic printing machine either in the simplex or duplex modes of operation. Preferably, controller 32 is a programmable microprocessor which controls all of the machine functions. The controller provides the storage and comparison of counts of the copy sheets, the number of documents being recirculated in the document sets, the number of copy sheets selected by the operator, time delays, jam correction controls, etc. The control of all the systems in the printing machine may be accomplished by conventional control switch inputs from the printing machine console selected by the operator. Sensors S1–S24 are employed for tracking or keeping track of the position of the documents and copy sheets. Controller 32 contains the necessary logic for achieving the foregoing. A programmable machine controller of this type is disclosed in U.S. Pat. No. 4,144,050 or U.S. Pat. No. 3,940,210, the relevent portions thereof being incorporated by reference into the present application. The detailed structure of sensors S1–S24 will be described hereinafter with reference to FIG. 2.

Invariably, after the copy sheet is separated from photoconductive surface 12 belt 10, some residual particles remain adhering thereto. These residual particles are removed from photoconductive surface 12 at cleaning station F. Cleaning station F includes a rotatably mounted fiberous brush 76 in contact with photoconductive surface 12 of belt 10. These particles are cleaned from photoconductive surface 12 of belt 10 by the rotation of brush 76 in contact therewith. Subsequent to cleaning, a discharge lamp (not shown) floods photoconductive surface 12 with light to dissipate any residual electrostatic charge remaining thereon prior to the charging thereof for the next successive imaging cycle. It is believed that the foregoing description is sufficient for purposes of the present invention to illustrate the general operation of an electrophotographic printing machine incorporating sensors S1–S24 therein.

Referring now to the specific subject matter of the present invention, inasmuch as all of the sensors S1–S24 are identical to one another, only one will be described hereinafter in detail. Thus, only sensor S1 will be described in greater detail with reference to FIG. 2.

As shown in FIG. 2, sensor S1 includes a flexible plastic strip 78 having piezoelectric properties, preferably, strip 78 is made from a polyvinylidene fluoride. Strip 78 is mounted in a cantilever fashion. Thus, end 80 of strip 78 is secured fixedly to the printing machine. End 82 of strip 78 is free. Strip 78 is mounted so as to be substantially normal to the direction of movement of the copy sheet, as indicated by arrow 84. As the lead edge of the copy sheet contacts strip 78, strip 78 is deflected and transmits an electrical signal to amplifier 86. The electrical signal transmitted is in the nature of an impulse signal. Amplifier 86 processes the impulse signal and amplifies it approximately twenty times. This signal is then transmitted to controller 32. Controller 32 receives the impulse signal indicative of the lead edge of the copy sheet deflecting piezoelectric strip 78. This actuates a timing sequence in controller 32. When the trail edge of the copy sheet passes over piezoelectric strip 78, another impulse signal is generated as strip 78 returns to the undeflected condition. This signal is also amplified by amplifier 86 and transmitted to controller 32. If controller 32 receives the second signal within a specified time, no action is taken. However, if there is a sheet jam and the trail edge of the copy sheet does not pass over strip 78, the second impulse signal is not received by controller 32. After the preselected time sequence has elapsed within controller 32, controller 32 generates a jam signal. This jam signal energizes display 88. In addition, the jam signal from controller 38 deactivates the printing machine. Thus, display 88 indicates to the machine operator that there is a copy sheet jammed along the sheet path. In addition, the printing machine is now deactivated. After the jammed copy sheet is removed from the printing machine, controller 32 will activate the printing machine and de-energize display 88.

In recapitulation, the sheet or document sensor is made from a flexible strip having piezoelectric properties. This strip is mounted in a cantilever fashion so as to be deflected by the copy sheet passing thereover. As the lead edge of the copy sheet deflects the strip, an impulse signal is generated. This impulse signal is amplified and transmitted to the printing machine controller. Similarly, after the trail edge of the copy sheet has passed over the strip, a second impulse signal is generated and transmitted to the controller. In this way, the controller knows that the copy sheet is moving along its prescribed path at the requisite velocity. This sensor for detecting copy sheet or document jams is relatively inexpensive, reliable and substantially free from contamination, as well as being insensitive to static electricity.

It is, therefore, evident that there has been provided in accordance with the present invention, a document or sheet sensor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A sheet transport, including:

means for moving a sheet along a selected path; and means, mounted with one end thereof fixed and the other end thereof free and positioned to have a generally planar surface thereof extending in a direction substantially transverse to the selected path of sheet movement, for generating an electrical signal in response to being bent by the sheet moving along the selected path.

2. A sheet transport according to claim 1, wherein said generating means includes:

a frame mounted stationarily on the transport; and a flexible strip having one end thereof mounted fixedly on said frame with the other end thereof being free, said strip extending into the path of sheet movement with the generally planar surface thereof being substantially normal to the sheet movement.

3. A sheet transport according to claim 2, wherein said flexible strip generates a first electrical signal in response to being bent by the leading edge of the moving sheet and a second electrical signal in response to the trailing edge of the sheet passing thereover.

4. A sheet transport according to claim 3, wherein said flexible strip has piezoelectric properties.

5. A sheet transport according to claim 4, further including means, coupled to said piezoelectric strip, for indicating a sheet jam in response to receiving only the first electrical signal.

6. An electrophotographic printing machine of the type in which a sheet moves along a selected path, wherein the improvement includes:

means for moving the sheet along the selected path; and means, mounted with one end thereof fixed and the other end thereof free and positioned to have a generally planar surface thereof extending in a direction substantially transverse to the selected path of sheet movement, for generating an electrical signal in response to being bent by the sheet moving along the selected path.

7. A printing machine according to claim 6, wherein said generating means includes:

a frame mounted stationarily on the printing machine; and a flexible strip having one end thereof mounted fixedly on said frame with the other end thereof being free, said strip extending into the path of sheet movement with the generally planar surface thereof being substantially normal to the sheet movement.

8. A printing machine according to claim 7, wherein said flexible strip generates a first electrical signal in response to being bent by the leading edge of the moving sheet and a second electrical signal in response to the trailing edge of the sheet passing thereover.

9. A printing machine according to claim 8, wherein said flexible strip has piezoelectric properties.

10. A printing machine according to claim 9, further including means, coupled to said piezoelectric strip, for indicating a sheet jam in response to receiving only the first electrical signal.

* * * * *